US005222449A

United States Patent [19]

Koie et al.

[11] Patent Number: 5,222,449

[45] Date of Patent: Jun. 29, 1993

[54] SEWING MACHINE CAPABLE OF FORMING A BUTTONHOLE IN A WORK PIECE

[75] Inventors: Kazuaki Koie, Tokoname; Hideo Ando, Konan; Akihiro Funahashi, Nagoya; Jun Shibata, Okazaki, all of Japan

[73] Assignee: Brother Kogyo Kabushiki Kaisha, Nagoya, Japan

[21] Appl. No.: 871,110

[22] Filed: Apr. 20, 1992

[30] Foreign Application Priority Data

May 27, 1991 [JP] Japan ..... 3-152594

[51] Int. Cl.[5] ..... D05B 3/06

[52] U.S. Cl. ..... 112/68; 112/264.1

[58] Field of Search ..... 112/447, 446, 66, 65, 112/70, 73, 76, 121.12, 121.15, 262.1, 264.1

[56] References Cited

U.S. PATENT DOCUMENTS 2,301,797 11/1942 Spaine ..... 112/71
4,501,207 2/1985 Miyazaki et al. ..... 112/66
4,552,080 11/1985 Miyazaki ..... 112/68
5,125,349 6/1992 Koie et al. ..... 112/66

*Primary Examiner*—Peter Nerbun
*Attorney, Agent, or Firm*—Oliff & Berridge

[57] ABSTRACT

A sewing machine comprises a feeding device which moves between the under position of the cutter apparatus and the under position of the needle bar with a work piece which is set on the feeding device such that the buttonhole slit is formed on a desired position, a setting signal transmitter for transmitting a complete signal when the work piece is set on the feeding device, and a post-buttonhole slit method indicator for indicating the post-buttonhole slit method in order to form the buttonhole slit by the cutter apparatus after buttonhole stitches are formed by the cooperation of the needle and the looper. When the post-buttonhole slit method is indicated by the post-buttonhole slit method indicator, the feeding device moves under the needle bar and the feeding device is controlled so as to stay under the needle bar until the setting signal transmitter inputs the complete signal.

15 Claims, 8 Drawing Sheets

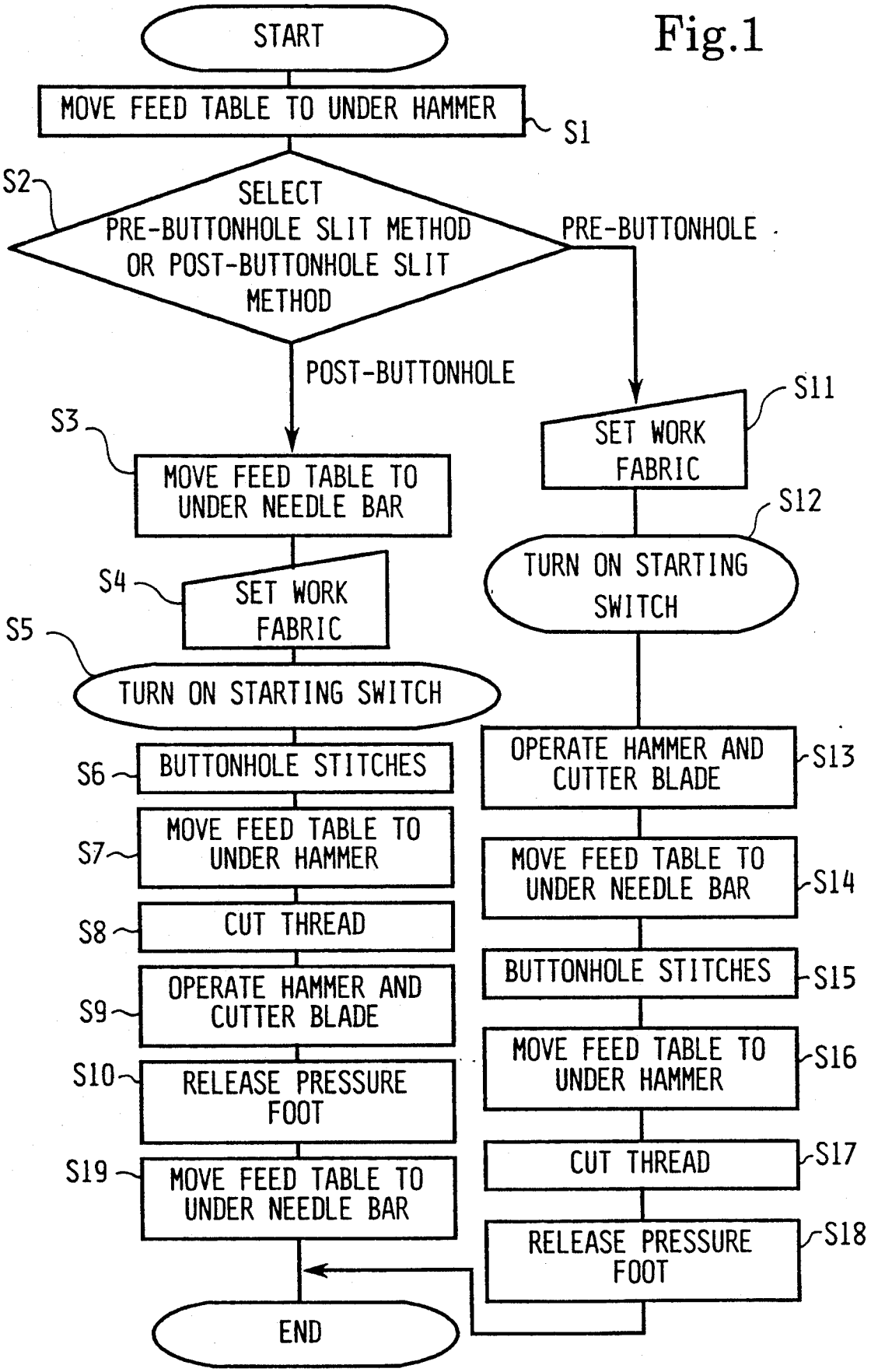
Fig.1
START
MOVE FEED TABLE TO UNDER HAMMER
S1
S2
SELECT PRE-BUTTONHOLE SLIT METHOD OR POST-BUTTONHOLE SLIT METHOD
PRE-BUTTONHOLE
POST-BUTTONHOLE
S3
MOVE FEED TABLE TO UNDER NEEDLE BAR
S4
SET WORK FABRIC
S5
TURN ON STARTING SWITCH
S6
BUTTONHOLE STITCHES
S7
MOVE FEED TABLE TO UNDER HAMMER
S8
CUT THREAD
S9
OPERATE HAMMER AND CUTTER BLADE
S10
RELEASE PRESSURE FOOT
S19
MOVE FEED TABLE TO UNDER NEEDLE BAR
END
S11
SET WORK FABRIC
S12
TURN ON STARTING SWITCH
S13
OPERATE HAMMER AND CUTTER BLADE
S14
MOVE FEED TABLE TO UNDER NEEDLE BAR
S15
BUTTONHOLE STITCHES
S16
MOVE FEED TABLE TO UNDER HAMMER
S17
CUT THREAD
S18
RELEASE PRESSURE FOOT

SEWING MACHINE CAPABLE OF FORMING A BUTTONHOLE IN A WORK PIECE

BACKGROUND OF THE INVENTION

1. Field of the Invention

The invention relates to a sewing machine capable of forming a buttonhole, and more particularly, to a sewing machine capable of shortening a cycle time for forming a buttonhole.

2. Description of Related Art

FIGS. 2, 3, and 4 show the structure of a buttonhole sewing machine. A frame 9 comprises a bed 12, a pedestal portion 10 and an arm 11. The pedestal portion 10 is mounted on the bed 12. The arm 11 extends from the pedestal portion 10 so as to be almost parallel to a bed side 12A of the bed 12. A hammer 4 is provided on the left side of the pedestal portion 10. The hammer 4 cooperates with a cutter blade 3 to form a buttonhole slit, such as a straight hole slit or an eyelet hole slit on the work fabric 7. The eyelet hole slit consists of a round portion and a straight portion. A needle bar 6 is provided under the head portion of the arm 11. The needle bar 6 forms buttonhole stitches around the periphery of the buttonhole slit in order to prevent threads from coming loose. The needle bar 6 has a needle 5 therein.

On the bed 12, there is provided a feed table 2 on which the work fabric 7 is set. The feed table 2 can move horizontally with the work fabric 7 so as to be almost parallel to the bed side 12A. A pressure foot 8 for holding the work fabric 7 is provided on the feed table 2. Under the feed table 2, a looper 1 and the cutter blade 3 are fixed to the bed 12. The looper 1 forms buttonhole stitches in cooperation with the needle 5. The cutter blade 3 is used as a lower knife and for preventing the work fabric 7 from getting out of position.

The operation of a conventional buttonhole sewing machine will now be described. Conventionally, a pre-buttonhole slit method and a post-buttonhole slit method are known. According to the pre-buttonhole slit method, buttonhole stitches are formed after the buttonhole slit is formed on the work fabric 7. On the other hand, according to the post-buttonhole slit method, the buttonhole slit is formed after buttonhole stitches are formed on the work fabric 7. Both methods can be selected in the conventional buttonhole sewing machine. Therefore, a user selects either the pre-buttonhole slit method or the post-buttonhole slit method based on the material of the work fabric 7.

FIG. 6 is a time chart for showing the operation of the pre-buttonhole slit method.

The user removes the processed work fabric and sets a non-processed work fabric 7 immediately under the hammer 4. A section AB of the time chart shows this operation time. When a starting switch is turned on, the hammer 4 comes in contact with the cutter blade 3 through the work fabric 7. The hammer 4 cooperates with the cutter blade 3 to form a cutout on the work fabric 7 as the buttonhole slit. A section CD of the time chart shows this operation time. The shape of each buttonhole slit is determined to be either the straight hole slit, or the eyelet hole slit whose one end has a round portion, according to the shape of the cutter blade 3. The feed table 2 moves with the work fabric 7 and the buttonhole slit in the work fabric 7 is placed under the needle 5. A section DE of the time chart shows this operation time.

Next, the buttonhole stitches are executed. The needle 5 and the looper 1 are simultaneously driven. As a result, the buttonhole stitches are formed around the periphery of the buttonhole slit on the work fabric 7. A section EF of the time chart shows this operation time. When the buttonhole stitches are completed, the feed table 2 moves with the work fabric 7 to a position under the hammer 4. A section FG of the time chart shows this operation time. Thus, the operation of the pre-buttonhole slit method is completed. The buttonhole sewing machine is ready for the user to remove the processed work fabric 7 and set a non-processed work fabric 7.

FIG. 7 is a time chart for showing the operation of the post-buttonhole slit method of the conventional buttonhole sewing machine. The user removes the processed work fabric and sets a non-processed work fabric 7 under the hammer 4. A section HI of the time chart shows this operation time. When the starting switch is turned on, the feed table 2 moves with the work fabric 7 to under the needle 5 where the buttonhole slit will be formed on the work fabric 7. A section JK of the time chart shows this operation time.

Next, the needle 5 and the looper 1 synchronously move in order to form buttonhole stitches. At that time, the feed table 2 moves with the work fabric 7 in synchronization with the movement of the needle 5 and the looper 1 so that buttonhole stitches are formed around the periphery of the place where the buttonhole slit will be formed. A section KL of the time chart shows this operation time. When the buttonhole stitches are completed, the feed table 2 moves with the work fabric 7 until the buttonhole stitches on the work fabric 7 are positioned under the hammer 4. A section LM of the time chart shows this operation time. Afterwards, the hammer 4 comes in contact with the cutter blade 3 through the work fabric 7 and between the buttonholes stitched defining the buttonhole. The hammer 4 cooperates with the cutter blade 3 to form a cutout in the work fabric 7 as the buttonhole slit. The shape of buttonhole slit is set in either the straight hole slit or the eyelet hole slit whose one end has a round portion. A section HN of the time chart shows this operation time. Thus, the operation of the post-buttonhole slit method is completed and the buttonhole sewing machine is ready for the user to remove the processed work fabric 7 and set a non-processed work fabric 7.

As described above, in both methods of the pre-buttonhole slit method and the post-buttonhole slit method, the user has to set the work fabric 7 under the hammer 4.

However, in the post-buttonhole slit method, there is technically no need for the user to set the work fabric 7 when the feed table 2 is under the hammer 4 as the first action is sewing the buttonhole. Further, it is troublesome for the user to set the work fabric 7 right under the hammer 4, because the user has to set the work fabric 7 while avoiding the needle 5.

In the post-buttonhole slit method, the feed table 2 moves from under the hammer 4 to right under the needle 5 by receiving the starting signal after the user sets the work fabric 7. Therefore, the cycle time for the series of operations of the post-buttonhole slit method is long. That is, the cycle time of the pre-buttonhole slit method is section AG, shown in FIG. 6, and the cycle time of the post-buttonhole slit method is section HN, shown in FIG. 7. It appears that the cycle time of the pre-buttonhole slit method is as long as that of the post-buttonhole slit method. However, in the pre-buttonhole slit method, the user can remove the processed work fabric 7 while the work fabric 7 is moving with the feed table 2 in section FG as the buttonhole has been fully formed. Therefore, for all practical purposes, the cycle time of the post-buttonhole slit method is longer than that of the pre-buttonhole slit method.

Moreover, since the user has to accurately set the work fabric 7 under the hammer 4 while avoiding the needle 5, the work efficiency for forming the buttonhole is reduced.

SUMMARY OF THE INVENTION

It is therefore an object of the invention to provide a sewing machine capable of shortening the cycle time for forming a buttonhole in the post-buttonhole slit method.

A sewing machine of the invention for forming the buttonhole in a work piece comprises: a bed; a pedestal portion based on the bed; an arm extending from the pedestal portion in the horizontal direction; a cutter apparatus provided under the arm in order to form the buttonhole slit on the work piece; a needle bar provided under the arm so as to be able to move vertically and disposed opposite to the pedestal portion with respect to the cutter apparatus; a looper provided below the needle bar in order to form buttonhole stitches on the work piece in cooperation with the needle; a feeding means which moves between under the cutter apparatus and under the needle bar with a work piece which is set on the feeding means such that the buttonhole slit is formed in a desired position; a setting signal transmitting means for transmitting a complete signal when the work piece is set on the feeding means; a post-buttonhole slit method indicating means for indicating the post-buttonhole slit method which forms the buttonhole slit by the cutter apparatus after buttonhole stitches are formed by the cooperation of the needle and the looper; and a control means for moving the feeding means under the needle bar when the post-buttonhole slit method is indicated by the post-buttonhole slit method indicating means and controlling the feeding means such that the feeding means stays under the needle bar until the setting signal transmitting means inputs the complete signal.

According to the sewing machine of the invention having the above-mentioned structure, when the post-buttonhole slit method is indicated by the post-buttonhole slit method indicating means, the control means controls the feeding means such that the feeding means stays under the needle bar until the setting signal transmitting means transmits the complete signal. At this time, the work piece is set on the feeding means such that the buttonhole slit is formed on a desired position.

According to the sewing machine of the invention, in the case where the post-button hole slit method is indicated, the feeding means stays under the needle bar until the setting signal transmitting means transmits the complete signal. Therefore, the user can set the work fabric under the needle and can further set the work fabric during the operation of the sewing machine. Thus, the cycle time for forming the buttonhole can be shortened, so that the work efficiency for forming the buttonhole rises.

BRIEF DESCRIPTION OF THE DRAWINGS

A preferred embodiment of the invention will be described in detail with reference to the following figures wherein:

FIG. 1 is a flowchart showing the operation of a buttonhole sewing machine of the invention;

DETAILED DESCRIPTION OF THE PREFERRED EMBODIMENTS

Hereinafter, one embodiment of the invention in a sewing machine capable of forming an eyelet hole will be explained with reference to the figures.

Figure 2:
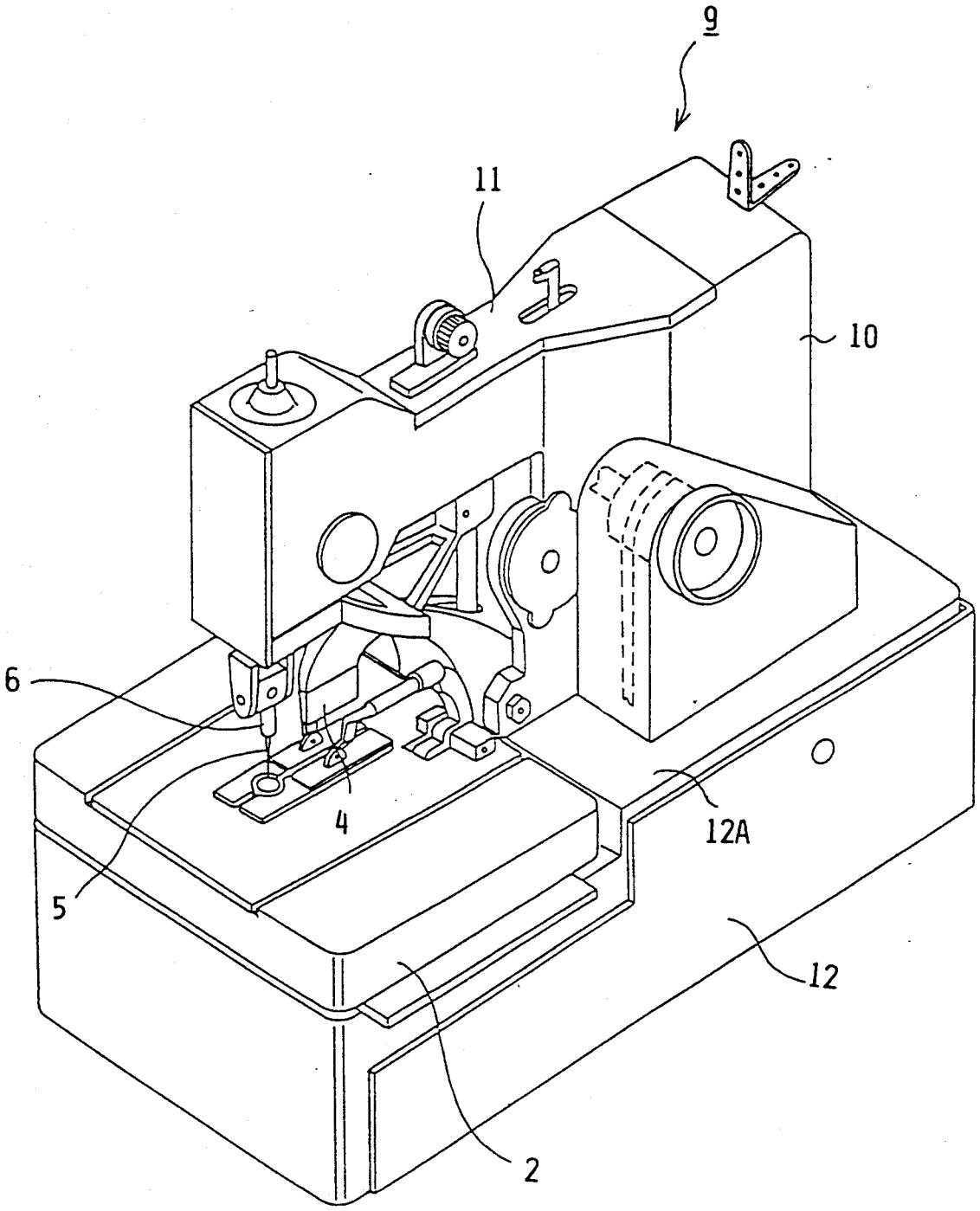
FIG. 2 is a perspective view showing the mechanical structure of a sewing machine.
Figure 3:
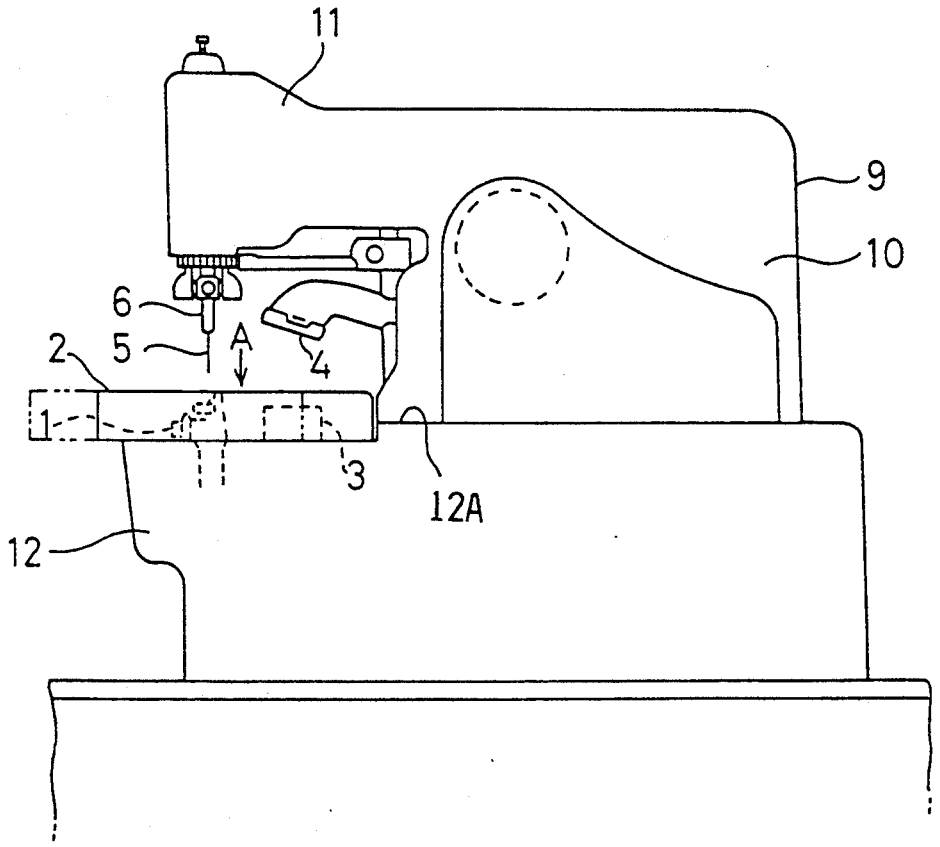
FIG. 3 is a cross-sectional view showing the mechanical structure of a sewing machine.
Figure 4:
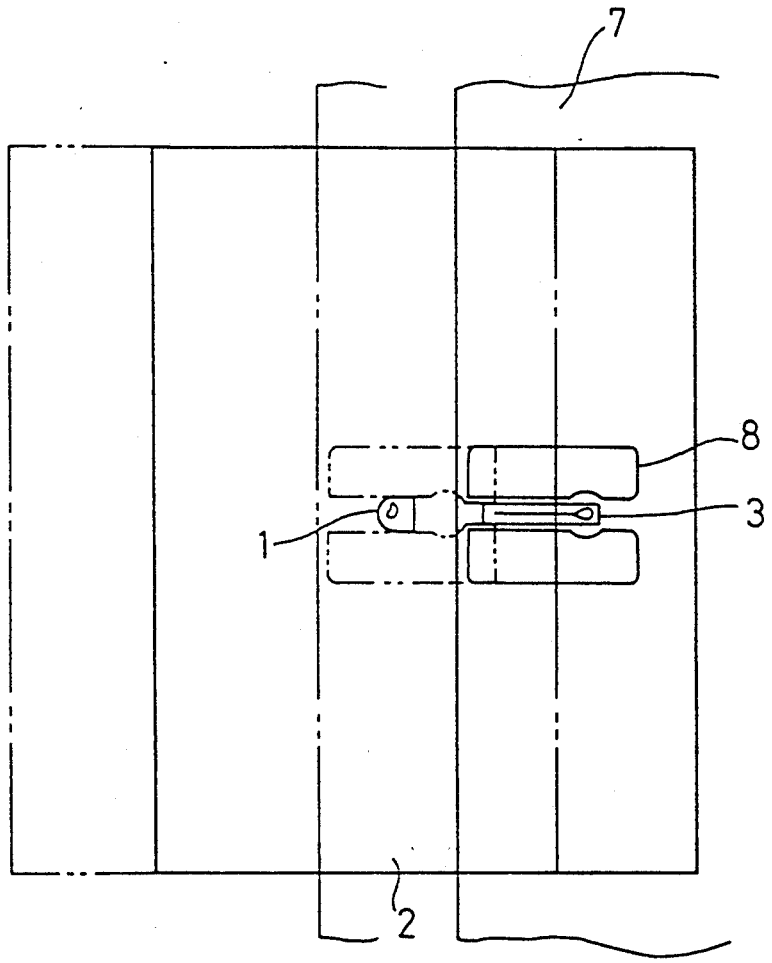
FIG. 4 is a plan view showing the mechanical structure of a sewing machine.

The mechanical elements of the present embodiment are almost the same as that of the conventional sewing machine. That is, as shown in FIGS. 2–4, a frame 9 comprises a bed 12, a pedestal portion 10 based on a bed side 12A of the bed 12 and an arm 11 extending from the pedestal portion 10 so as to be parallel to the bed side 12A. A hammer 4 for forming a buttonhole slit on the work fabric 7 is disposed on the left side of the pedestal portion 10. The shape of the buttonhole slit is an eyelet hole slit whose one end has a round portion. A needle bar 6 is provided under the head portion of the arm 11 so as to be able to vertically move. The needle bar 6 has a needle 5 therein. The needle 5 forms buttonhole stitches in cooperation with a looper 1 around the periphery of the buttonhole slit in order to prevent threads from getting loose.

A feed table 2 capable of moving with the set work fabric 7 along the bed side 12A with respect to the needle 5 is provided on the bed 12. A pressure foot 8 is provided on the feed table 2. The work fabric 7 is placed between the pressure foot 8 and the feed table 2 so as not to get out of position. Under the feed table 2, the looper 1 and a cutter blade 3 are fixed to the bed 12. The looper 1 forms stitches in cooperation with the needle 5. The cutter blade 3 is used as an lower knife and for preventing the work fabric 7 from getting out of position when the hammer 4 is operated.

Figure 5:
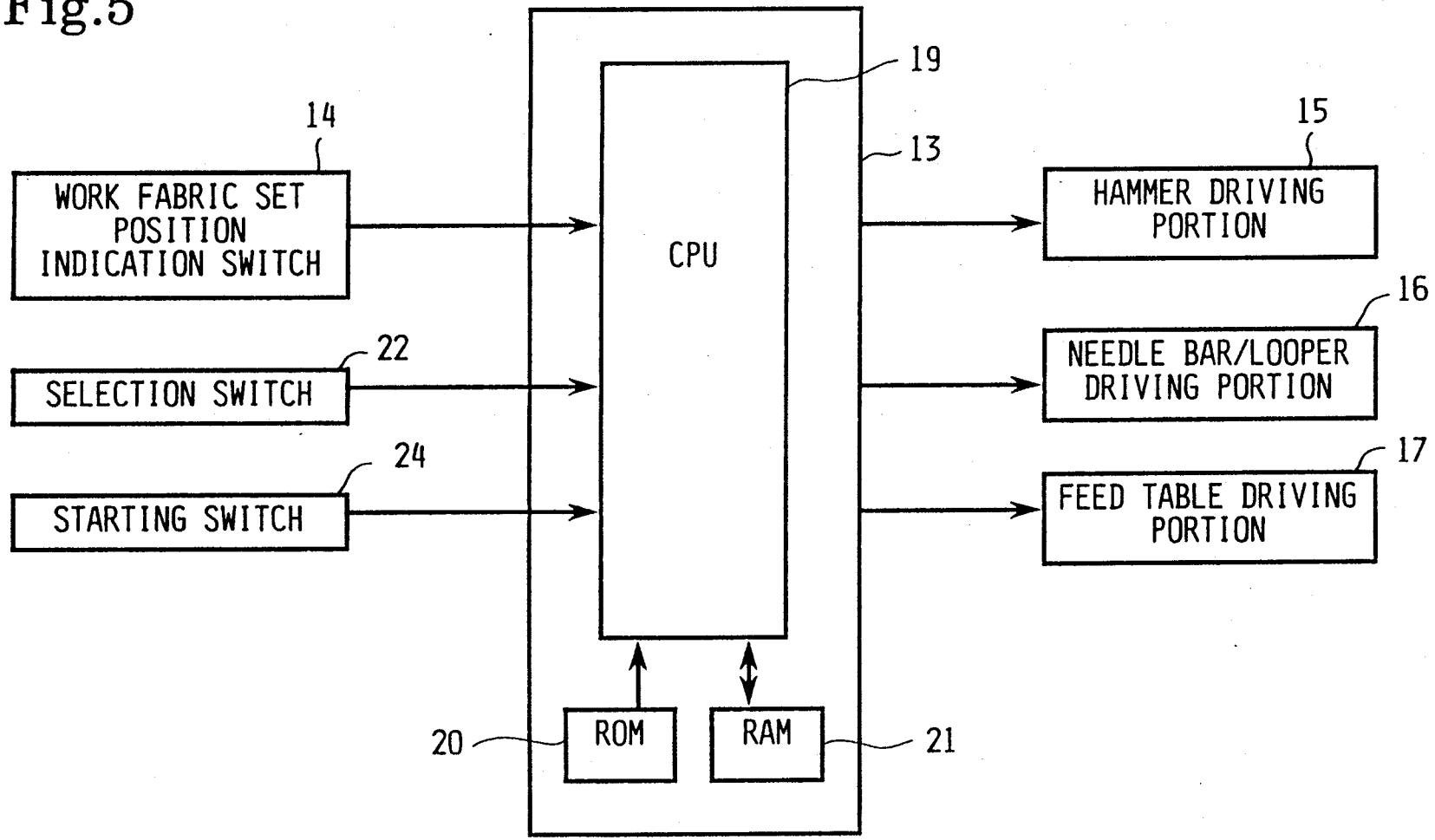
FIG. 5 is a block diagram showing the structure of the control device of the sewing machine.
Figure 6:
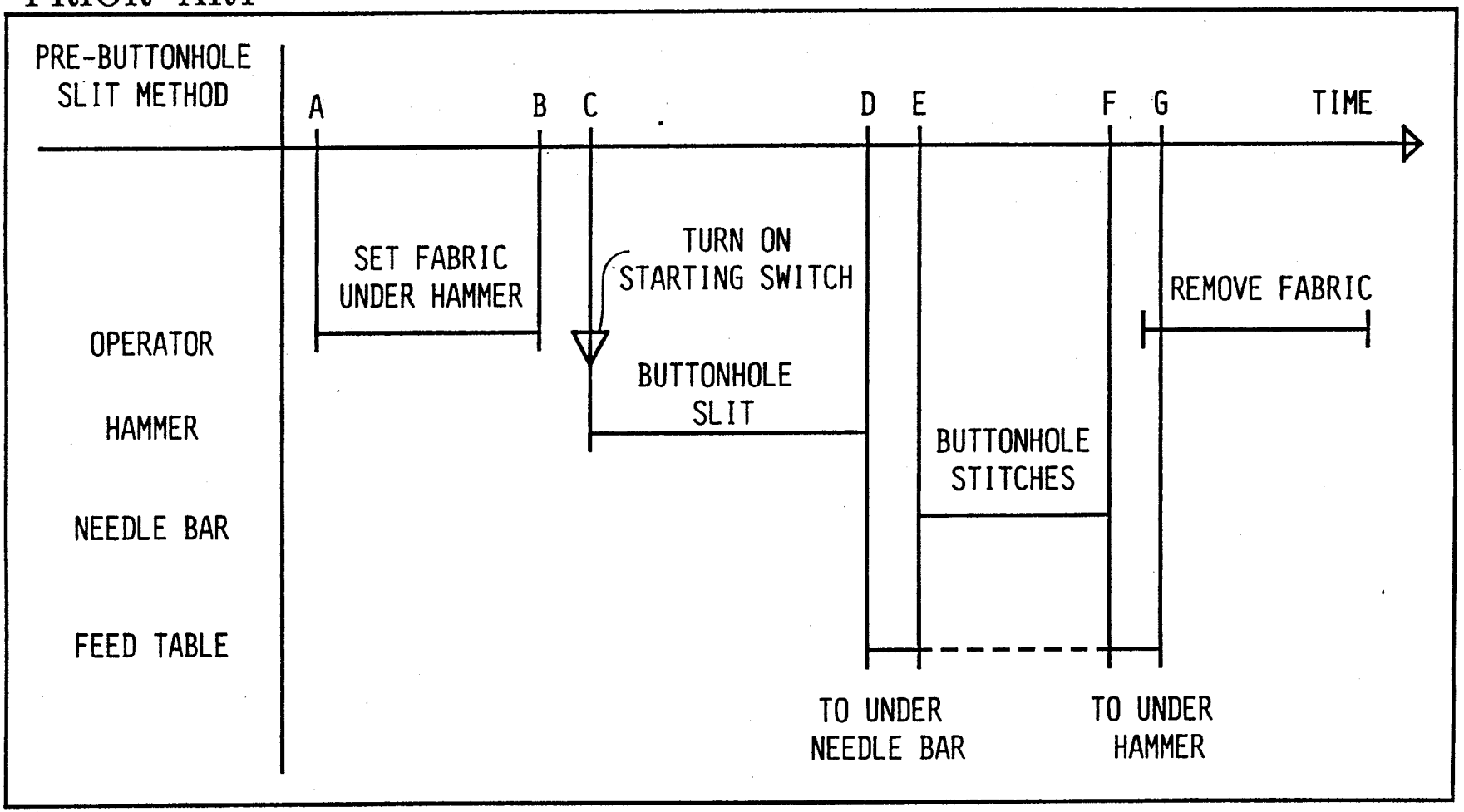
Fig.6 PRIOR ART
FIG. 6 is a time chart showing the operation of the sewing machine in a conventional pre-buttonhole slit method.
Figure 7:
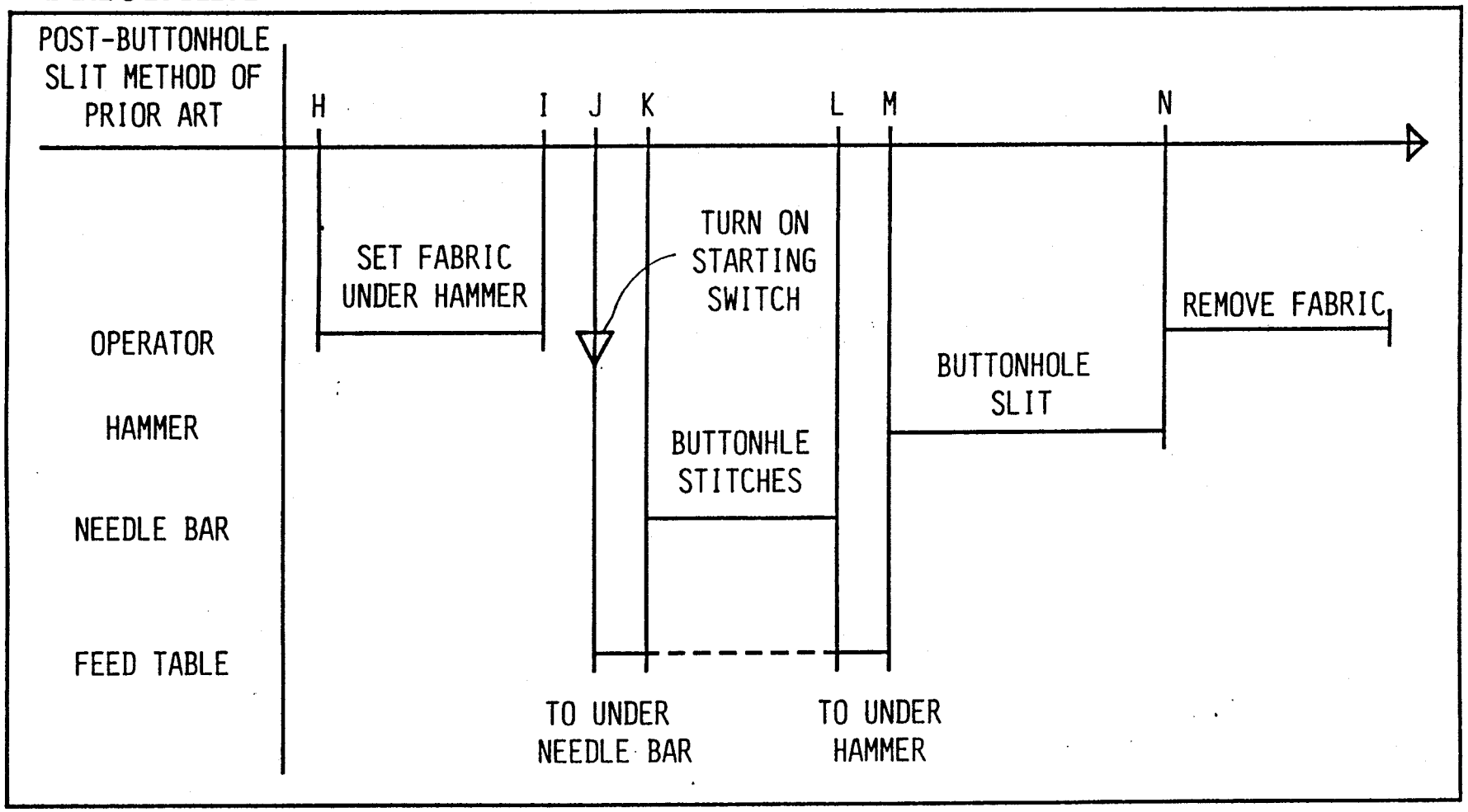
Fig.7 PRIOR ART
FIG. 7 is a time chart showing the operation of the sewing machine in a conventional post-buttonhole slit method.

The construction of the control device will be explained with reference to FIG. 5. The control device 13 controls the buttonhole sewing machine. The control device 13 comprises a program ROM 20 for storing all control programs, a CPU 19 for reading out a control program from the ROM 20 and giving a drive instruction to each drive element as a processor, and a RAM 21 for temporarily storing data. A work fabric set position indication switch 14 and a selection switch 22, which is used to select either the pre-buttonhole slit method or the post-buttonhole slit method, are connected to the control device 13. The selection switch 22 also constitutes an indicating means for indicating a pre-buttonhole slit method selection or a post-hole slit method selection with the associated stop position. Further, starting switch 24 is provided as a setting signal transmitting means to indicate the work piece is set on the feed table. The starting switch 24 is connected to the CPU 19. A hammer driving portion 15 for driving the hammer 4, a needle bar/looper driving portion 16 for synchronously driving the needle bar 6 and the looper 1, and a feed table driving portion 17 for driving the feed table 2 are connected to the control device 13.

The control to be executed in the buttonhole sewing machine will be explained with reference to FIG. 1. According to the buttonhole sewing machine of the invention, a user can select either the pre-buttonhole slit method or the post-buttonhole slit method using the selection switch 22. The steps of the control are shown as S0, S1, S2, . . . .

When the power source is turned on (S0), the feed table 2 moves under the hammer 4 to a starting position (S1). The operation then varies according to the selection made using the selection switch 22 (S2). When the pre-buttonhole slit method is selected, the operation is similar to that of the conventional buttonhole sewing machine. Therefore description of the operation is omitted.

In the case where the post-buttonhole slit method is selected, the feed table 2 moves to under the needle bar 6 as an operation starting position (S3). Then, the sewing machine stops operating and awaits an indication that the user has removed the processed work fabric and set a non-processed work fabric 7 (S4). The user turns on the starting switch 24 after setting the work fabric (S5). When the starting switch 24 is turned on, the needle 5, the looper 1 and the feed table 2 form a buttonhole stitch in cooperation with each other (S6). When the buttonhole stitch is complete, the feed table 2 moves the work fabric 7 so that the stitched buttonhole, on the work fabric 7, is placed under the hammer 4 (S7). While the feed table moves, the thread is cut (S8). After the feed table completes movement, the hammer 4 is operated in cooperation with the cutter blade 3 in order to form the buttonhole slit in the center portion of the buttonhole stitches (S9). After the hammer 4 is operated, the pressure foot 8 is released (S10). The feed table 2 is then moved under the needle bar 6 as the operation starting position (S19), and the control series is completed.

Figure 8:
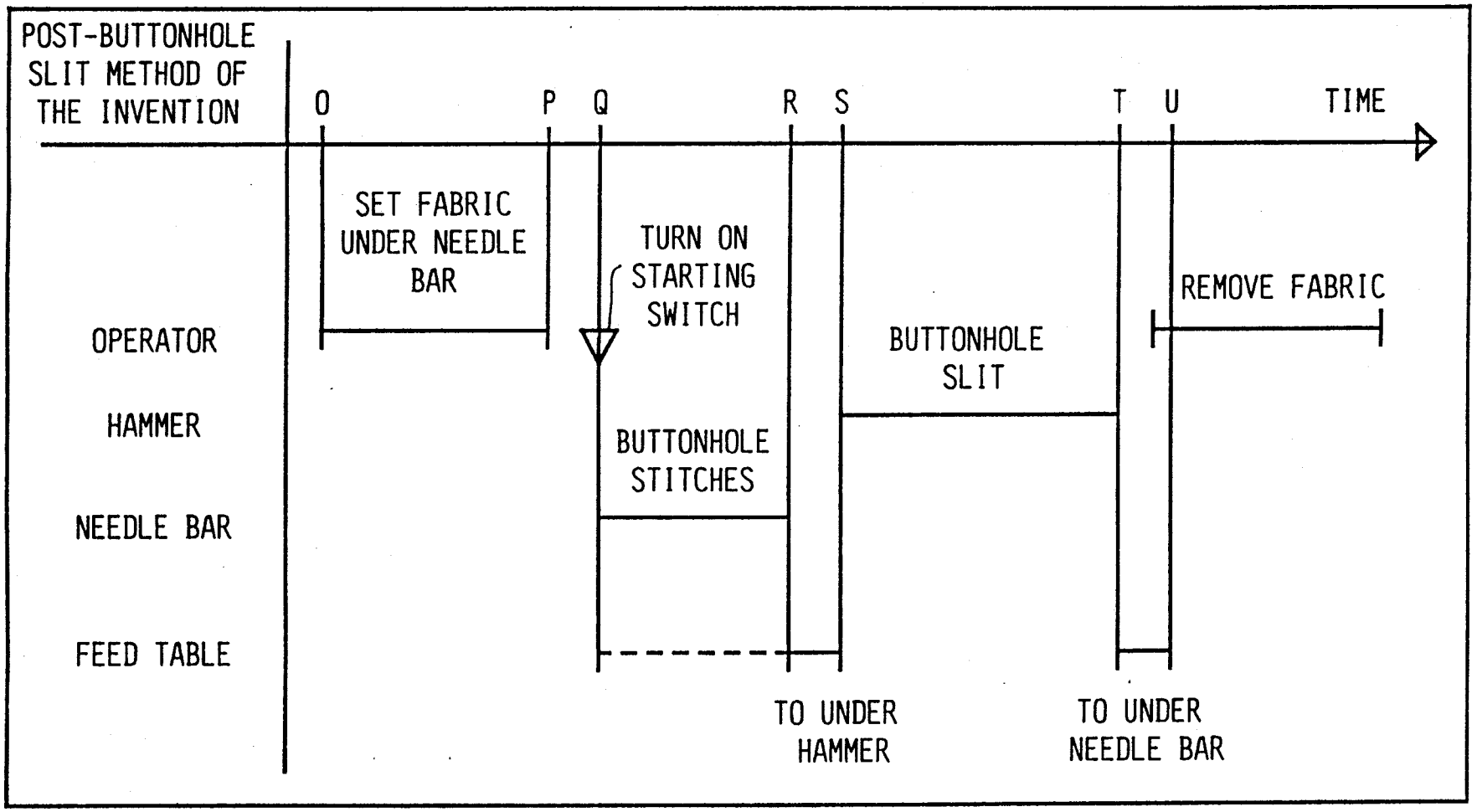
FIG. 8 is a time chart showing the operation of the sewing machine in a post-buttonhole slit method of the invention.

The control of the invention as described above will be explained with reference to the time chart of FIG. 8. The user removes the processed work fabric and puts the work fabric 7 in a predetermined position on the feed table 2 such that the work fabric 7 is supported by the pressure foot 8. This operation is called the work fabric set operation. A section OP of the time chart shows this operation time. At this time, the feed table 2 is right under the needle 5. After the user sets the work fabric 7, the user confirms that the user's hands are in a safe position and turns on the starting switch 24. As soon as the starting switch 24 is turned on, the sewing machine begins forming buttonhole stitches. The needle 5 and the looper 1 are synchronously moved by the control device 13 through the needle/looper driving means 16 so that buttonhole stitches are formed on the work fabric 7. At this time, the feed table 2 is moved in synchronization with the movement of the needle 5 by the control device 13. Thus, buttonhole stitches are formed around the place where the buttonhole slit will be formed on the work fabric 7. Since the control method for forming stitches is disclosed in U.S. Pat. No. 4,501,207, which is incorporated by reference, the description of that method is omitted. A section QR of the time chart shows this operation time. When the buttonhole stitches are completed, the feed table 2 moves with the work fabric 7 to place the stitched buttonhole under the hammer 4. While moving the feed table 2 to under the hammer 4, the thread is cut. A section RS of the time chart shows this operation time. Afterwards, the hammer 4 comes in contact with the cutter blade 3 through the work fabric 7 so that the work fabric 7 is cut along the length of the buttonhole stitches. Thus, the buttonhole is formed. The shape of the buttonhole slit is an eyelet hole slit whose one end has a round portion. A section ST of the time chart shows this operation time. After the hammer 4 is operated, the feed table 2 moves with the work fabric 7 to directly under the needle bar 6 if another post-buttonhole slit is to be executed. Then, the sewing machine ends the operation.

As soon as the operation of the hammer 4 is completed, the user can start the work fabric set operation. That is, the user can remove the work fabric 7 while the feed table 2 is still moving under the needle position from the cutter portion. Therefore, a section 0P of the time chart is shortened, so that the cycle time 0U for the series of all operations can be shortened.

According to the above-mentioned embodiment, the operation starting position is positioned under the needle bar 6 in the post-buttonhole slit method. However, it may be such that the user can arbitrarily indicate the operation starting position. In this case, the buttonhole sewing machine of the present invention differs from the conventional buttonhole sewing machine in the following respect. That is, in the buttonhole sewing machine of the invention, the work fabric set position, or operation starting position, indication switch 14 is provided. By operating the work fabric set position indication switch 14 in order to efficiently set the work fabric, the user can arbitrarily indicate a stop position where the feed table 2 stops after the buttonhole is formed. However, in the conventional buttonhole sewing machine, in case where the pre-buttonhole slit method is selected by the selection switch 22, the operation starting position is under the hammer 4 which is the starting position. However, according to the buttonhole sewing machine of the present embodiment, if the user indicates the needle bar under position as the operation starting position, the user can exchange the work fabric 7 under the needle bar 6 even if in the pre-buttonhole slit method.

In the above-mentioned embodiment, the feed table 2 is limited so as to stop in the two places which are under the cutter portion and under the needle bar. However, a third stop position of the feed table 2 may be provided. The third stop position may be on the user's side rather than under the needle bar 6. Moreover, it may be that the user can select the third stop position as the operation starting position in both the pre-buttonhole slit method and the post-buttonhole slit method. Therefore, the user can exchange the work fabric or set the work fabric in a place which is not obstructed by the hammer 4 or the needle 6 and the cycle time for the series of operations can be further shortened.

What is claimed is:

1. A sewing machine capable of forming a buttonhole on the work piece comprising:

a bed;
a pedestal portion based on the bed;
an arm extending from the pedestal portion in the horizontal direction;
a cutter apparatus provided under said arm in order to form a buttonhole slit on the work piece;
a needle bar provided under said arm so as to be able to move vertically and disposed opposite to said pedestal portion with respect to said cutter apparatus;
a looper provided below said needle bar in order to form buttonhole stitches on the work piece in cooperating with the needle;
a feeding means which moves between under said cutter apparatus and under said needle bar with a work piece which is set on the feeding means such that the buttonhole slit is formed on a desired position;
a setting signal transmitting means for transmitting a complete signal when the work piece is set on said feeding means;
a post-buttonhole slit method indicating means for indicating the post-buttonholed slit method which forms the buttonhole slit by said cutter apparatus after buttonhole stitches are formed by the cooperation of the needle and the looper; and
a control means for moving said feeding means under said needle bar when the post-buttonhole slit method is indicated by said post-buttonhole slit method indicating means and controlling the feeding means such that said feeding means stays under said needle bar until said setting signal transmitting means inputs the complete signal.

2. A sewing machine capable of forming a buttonhole on the work piece comprising:
a bed;
a pedestal portion based on the bed;
an arm extending from he pedestal portion in the horizontal direction;
a cutter apparatus provided under said arm in order to form a buttonhole slit on the work piece;
a needle bar provided under said arm so as to be able to vertically move and disposed opposite to said pedestal portion with respect to said cutter apparatus;
a feeding means which moves between under said cutter apparatus and under said needle bar with a work piece which is set on the feeding means such that the buttonhole slit is formed on a desired position;
a setting signal transmitting means for transmitting a complete signal when the work piece is st on said feeding means;
a stop position indication means for indicating a stop position on said bed where said feeding means is stopped upon completion of forming the button hole; and
a control means for controlling said feeding means such that said feeding mans stays in the position which is indicated by said stop position indication means until said setting signal transmitting means inputs the complete signal.

3. A method of forming button holes on a workpiece using a sewing machine, comprising the step of:
positioning a workpiece feed table under a buttonhole hammer;
selecting an operation from a group consisting of a pre-buttonhole slit operation and a post-buttonhole slit operation;
positioning the workpiece feed table under a needle bar mounting a needle if the post buttonhole slit operation has been selected;
setting the workpiece;
performing the selected operation;
cutting the thread; and
releasing the workpiece.

4. The method of claim 3, wherein said positioning step comprises locating the workpiece feed table under a needle bar when the post-buttonhole operation is selected.

5. The method of claim 4, wherein performing the post-buttonhole operation further comprises the steps of:
sewing buttonhole stitches;
repositioning the workpiece feed table under the buttonhole hammer;
cutting a buttonhole using the buttonhole hammer;
releasing the workpiece; and
returning the workpiece feed table to a position under the needle bar.

6. The method of claim 5, wherein the cutting the thread step occurs during the repositioning step.

7. The method of claim 3, wherein performing the pre-buttonhole operation further comprises the steps of:
cutting a buttonhole using the buttonhole hammer with the workpiece feed table initially located under the buttonhole hammer;
repositioning the workpiece feed table under a needle bar;
sewing buttonhole stitches;
returning the workpiece feed table to under the buttonhole hammer.

8. The method of claim 7, wherein the cutting the third step occurs during the returning step.

9. The sewing machine as claimed in claim 1, wherein following selection of the post-buttonhole slit method, said feeding mean is moved under said needle bar to permit an operator to place a no-processed workfabric on said feeding means.

10. The sewing machine as claimed in claim 1, further comprising a thread cutter, wherein following sewing of a buttonhole, said feeding mean is moved under said cutter apparatus with said thread cutter cutting a thread during movement, said cutter apparatus then cuts a buttonhole within the stitched buttonhole, said pressure foot is released and said feeding means returns to under said needle bar.

11. The sewing machine as claimed in claim 10, wherein the work fabric may be removed from said feeding means anytime after the release of said foot.

12. The sewing machine as claimed in claim 2, wherein said stop position is a one selected from the group consisting of a position under the needle bar and a position under the cutter apparatus.

13. The sewing machine as claimed in claim 123, wherein the stop position is a third position between the position under the needle bar and the position under the cutter apparatus thereby providing a position for exchanging a work fabric that is not obstructed by either the needle bar or the cutter apparatus.

14. The sewing machine as claimed in claim 1, further comprising a work fabric set position indication means for selecting a start position where the work fabric may be set on said feeding means t a position between the needle bar ad the cutter apparatus.

15. The sewing machine as claimed in claim 2, further comprising a work fabric set position indication means for selecting a start position where the work fabric may be set on said feeding means at a position between the needle bar and the cutter apparatus.

* * * * *